US008661708B2

(12) United States Patent
Park

(10) Patent No.: US 8,661,708 B2
(45) Date of Patent: Mar. 4, 2014

(54) CRAMPON FOR GOLF SHOES AND CLIMBING IRONS

(75) Inventor: Wan-Do Park, Bucheon-si (KR)

(73) Assignee: Wookyung Tech Co., Ltd., Gyeonggi-do (KR)

( * ) Notice: Subject to any disclaimer, the term of this patent is extended or adjusted under 35 U.S.C. 154(b) by 1065 days.

(21) Appl. No.: 12/311,504

(22) PCT Filed: Oct. 31, 2007

(86) PCT No.: PCT/KR2007/005421

§ 371 (c)(1),
(2), (4) Date: Jan. 1, 2010

(87) PCT Pub. No.: WO2008/056906

PCT Pub. Date: May 15, 2008

(65) Prior Publication Data

US 2010/0139118 A1 Jun. 10, 2010

(30) Foreign Application Priority Data

Nov. 6, 2006 (KR) ..... 10-2006-0108785
Mar. 2, 2007 (KR) ..... 10-2007-0020838

(51) Int. Cl.

| | |
|---|---|
| ***A43B 3/10*** | (2006.01) |
| ***A43C 15/00*** | (2006.01) |
| ***A43B 1/10*** | (2006.01) |
| ***A43B 3/18*** | (2006.01) |

(52) U.S. Cl.
USPC ..... 36/7.6; 36/62; 36/7.3; 36/7.7

(58) Field of Classification Search
USPC ... 36/7.6, 67 R, 67 A, 67 D, 59 A, 59 C, 127, 36/62, 64, 65, 134
See application file for complete search history.

(56) References Cited

U.S. PATENT DOCUMENTS 56,391 A * 7/1866 Ethridge ..... 36/17 R
334,383 A * 1/1886 Holland ..... 36/7.6

(Continued)

FOREIGN PATENT DOCUMENTS

JP 06189802 A * 7/1994 ..... A43B 5/00
JP 10-146205 7/1998

(Continued)

*Primary Examiner* — Khoa Huynh
*Assistant Examiner* — Timothy K Trieu
(74) *Attorney, Agent, or Firm* — Dilworth & Barrese, LLP.

(57) ABSTRACT

A crampon capable of being worn on general footwear for golf shoes and climbing irons is disclosed, in which because of small volume and light load, the crampon has a cheap and conveniently portable advantage. The crampon includes a spike pad of an elastic material provided with a plurality of spikes; a limb band having first bands extending towards a toe of shoes from two corners of the spike pad and second bands extending towards a heel of the shoes from two corners, the first bands and the second bands being symmetrically formed; a circular-shaped ring band connecting front ends of the limb band and made of an elastic material; a trapezoidal toe locking opening formed by the first bands and a first arc portion of the ring band connecting the first bands; a heel locking opening formed by the second bands and a second arc portion of the ring band connecting the second bands; and front left and right holding portions formed by a third arc portion connecting the first arc portion and the second arc portion; in which the second arc portion formed at a rear portion of the second bands extends in a circular shape, and a heel pad for supporting a heel of the shoes is coupled to the second arc portion via the heel limb band.

14 Claims, 11 Drawing Sheets

(56) References Cited

U.S. PATENT DOCUMENTS

| | | | | | |
|---|---|---|---|---|---|
| 508,328 | A | * | 11/1893 | Loyd | 36/7.6 |
| 518,682 | A | * | 4/1894 | Weyand | 36/7.6 |
| 577,475 | A | * | 2/1897 | Zandalazini | 36/7.6 |
| 817,800 | A | * | 4/1906 | Pickett | 36/7.6 |
| 1,032,600 | A | * | 7/1912 | Grout | 36/62 |
| 1,205,983 | A | * | 11/1916 | Emmerth | 36/7.5 |
| 1,311,079 | A | * | 7/1919 | McDermott | 36/7.6 |
| 1,370,065 | A | * | 3/1921 | Stephens | 36/59 R |
| 1,506,662 | A | * | 8/1924 | Peller | 36/1 |
| 1,926,434 | A | * | 9/1933 | Collins | 36/59 R |
| 1,935,944 | A | * | 11/1933 | Dunn | 36/7.6 |
| 1,946,396 | A | * | 2/1934 | Fagelson | 36/7.6 |
| 2,102,601 | A | * | 12/1937 | Murber | 36/7.6 |
| 3,025,615 | A | * | 3/1962 | Patton | 36/7.6 |
| 3,156,988 | A | * | 11/1964 | Rause | 36/81 |
| 4,525,939 | A | * | 7/1985 | McNeil et al. | 36/7.6 |
| 4,783,913 | A | * | 11/1988 | Aoyama | 36/134 |
| 5,036,606 | A | * | 8/1991 | Erich et al. | 36/134 |
| 5,459,948 | A | * | 10/1995 | Aveni | 36/100 |
| 5,499,458 | A | * | 3/1996 | Krunic | 36/7.6 |
| 5,709,042 | A | * | 1/1998 | Houdroge | 36/62 |
| 5,848,482 | A | * | 12/1998 | Bathum | 36/127 |
| 5,870,838 | A | * | 2/1999 | Khayat | 36/61 |
| 5,921,005 | A | * | 7/1999 | Bell et al. | 36/59 R |
| 5,966,840 | A | * | 10/1999 | Bell et al. | 36/7.6 |
| 6,151,805 | A | | 11/2000 | Savoie | |
| 6,154,982 | A | * | 12/2000 | Bell et al. | 36/7.6 |
| 6,182,379 | B1 | * | 2/2001 | Savage | 36/62 |
| 6,301,804 | B1 | * | 10/2001 | Battaglia | 36/7.6 |
| 6,389,714 | B1 | * | 5/2002 | Mack | 36/61 |
| 7,089,688 | B2 | * | 8/2006 | Giovale | 36/7.6 |
| 7,152,344 | B2 | * | 12/2006 | Yoo | 36/61 |
| 7,409,782 | B2 | * | 8/2008 | Larson et al. | 36/59 R |
| D583,542 | S | * | 12/2008 | Gerber | D2/962 |
| 7,461,467 | B2 | * | 12/2008 | Park et al. | 36/7.6 |
| 7,836,610 | B2 | * | 11/2010 | Laporte | 36/62 |
| 7,926,205 | B2 | * | 4/2011 | ÅMark | 36/61 |
| 8,122,617 | B1 | * | 2/2012 | Dixon et al. | 36/61 |
| 8,256,145 | B2 | * | 9/2012 | Baucom et al. | 36/61 |
| 2003/0154626 | A1 | * | 8/2003 | Larson et al. | 36/7.6 |
| 2005/0198860 | A1 | * | 9/2005 | Larson et al. | 36/7.6 |
| 2006/0080861 | A1 | * | 4/2006 | Park et al. | 36/7.6 |
| 2010/0058615 | A1 | * | 3/2010 | Couder | 36/62 |
| 2010/0139118 | A1 | * | 6/2010 | Park | 36/7.6 |

FOREIGN PATENT DOCUMENTS

| | | |
|---|---|---|
| JP | 2003-70508 | 3/2003 |
| KR | 10-2005-0080012 | 8/2005 |

* cited by examiner

30 : (31a,31b,32a,32b)
30a : (35a,35b,36a,36b)
40 : (41,42,53)

30:(31a,31b,32a,32b,37a,37b) 40:(41,42,43)
30a:(33,34,35a,35b,36a,36b)

[Fig. 15
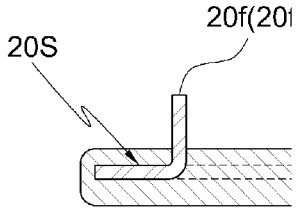
[Fig. 16]

CRAMPON FOR GOLF SHOES AND CLIMBING IRONS

TECHNICAL FIELD

The present invention relates to a crampon capable of being worn on general footwear for golf shoes and climbing irons, in which because of small volume and light load, the crampon has a cheap and conveniently portable advantage.

BACKGROUND ART

Golf shoes have spikes under an outsole so as to prevent slippage on grass upon rounding or swing and prevent the grass from being damaged.

Since the spikes are attached to the outsole of the shoes, golfers wear the golf shoes in a golf course, while sear general footwear at other sites. There is a cumbersome in that the golfers should carry expensive golf shoes of large volume and heavy load when going to the golf course.

Also, if the spikes are worn, the golf shoes should be wasted. Therefore, the technology for replacing the spikes only has been proposed in recent.

However, the golfer should carry the golf shoes of large volume and heavy load, and assembly or disassembly the spikes troublesomely.

In order to solve the above drawbacks, the applicant filed a patent (Korean Patent Application No. 2005-0059111, entitled Safety Crampon with Generality Put on).

The crampon of the patent includes a pad provided with a plurality of spikes, a toe locking opening, a heel locking opening, and an elastic band having press portions for connecting the toe and heel locking openings.

The pad and locking opening portions form a flat body at a free state, while the pad with the spikes becomes an outsole and the locking opening portions and the press portions enclose the shoes at a wearing state. Therefore, the crampon elastically presses and grips the shoes so that the crampon is not come off from the shoes.

Consequently, if the crampon is worn on the general footwear, a user can safely climb a mountain and safely walk on a skiddy icy mad, and has a conveniently portable advantage.

The applicant pays attention to the application of golf shoes, as well as the climbing irons.

DISCLOSURE OF INVENTION

Technical Problem

Therefore, an object of the present invention is to solve the problems involved in the prior art, and to provide a crampon capable of being worn on general footwear for golf shoes and climbing irons, in which because of small volume and light load, the crampon has a cheap and conveniently portable advantage.

Technical Solution

In order to achieve these and other objects, the present invention provides a crampon for golf shoes, comprising: a spike pad of an elastic material provided with a plurality of spikes; a limb band having first bands extending towards a toe of shoes from two corners of the spike pad and second bands extending towards a heel of the shoes from two corners, the first bands and the second bands being symmetrically formed; a circular-shaped ring band connecting front ends of the limb band and made of an elastic material; a trapezoidal toe locking opening formed by the first bands and a first arc portion of the ring band connecting the first bands; a heel locking opening formed by the second bands and a second arc portion of the ring band connecting the second bands; and front left and right holding portions formed by a third arc portion connecting the first arc portion and the second arc portion; in which the second arc portion formed at a rear portion of the second bands extends in a circular shape, and a heel pad for supporting a heel of the shoes is coupled to the second arc portion via the heel limb band.

Advantageous Effects

The crampon can be worn on general footwear for golf shoes and climbing irons, in which because of small volume and light load, the crampon has a cheap and conveniently portable advantage.

BRIEF DESCRIPTION OF THE DRAWINGS

The above objects, other features and advantages of the present invention will become more apparent by describing the preferred embodiment thereof with reference to the accompanying drawings, in which:

FIG. 15 is a cross-sectional view of the steel plate in FIG. 14.

FIG. 16 is a perspective view illustrating a mounting state of the steel plate in FIG. 13.

BEST MODE FOR CARRYING OUT THE INVENTION

Reference will now be made in detail to preferred embodiments of the present invention, examples of which are illustrated in the accompanying drawings.

Figure 1:
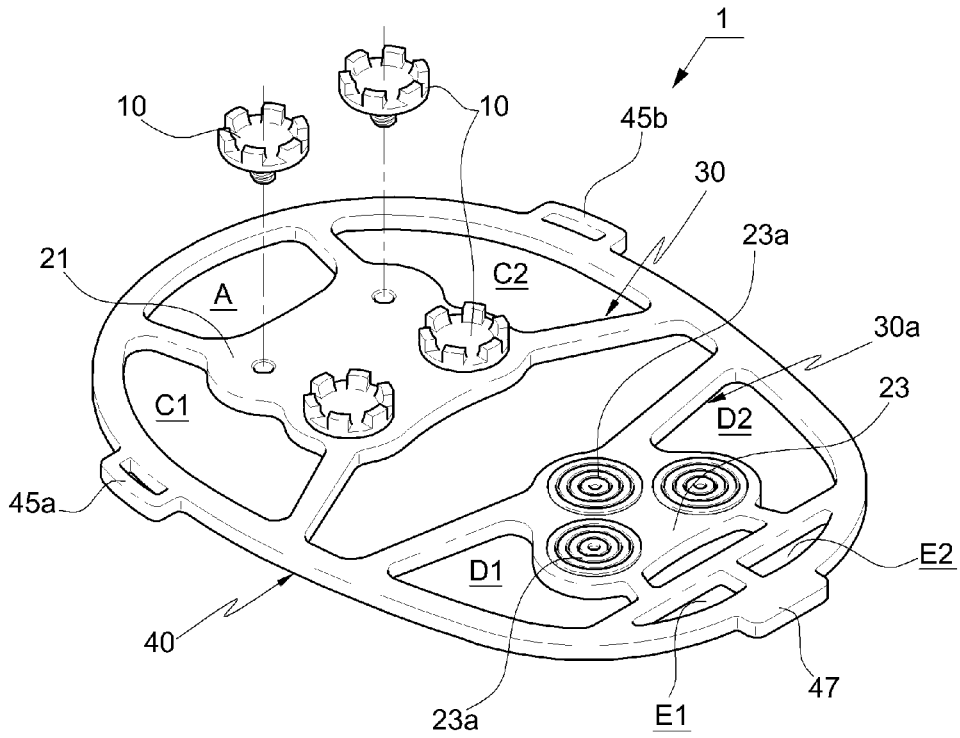
FIG. 1 is an exploded perspective view illustrating a crampon according to an embodiment of the present invention.
Figure 2:
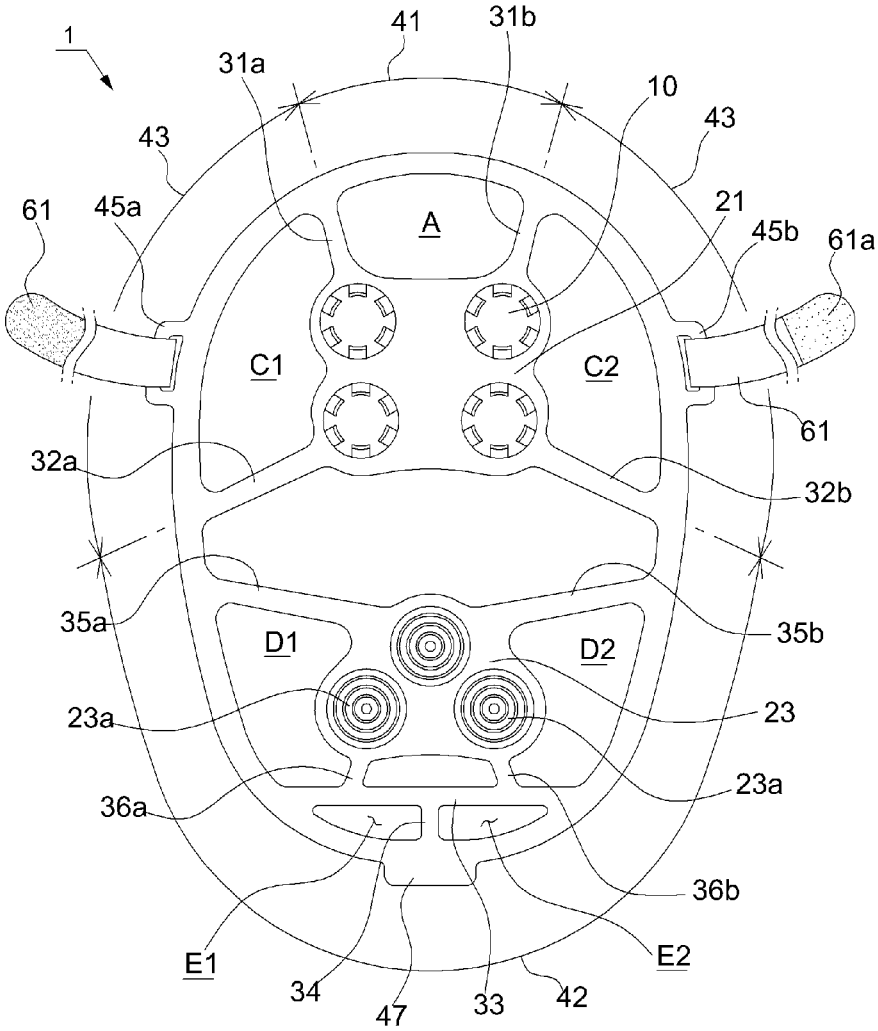
FIG. 2 is a plan view of the crampon in FIG. 1.
Figure 3:
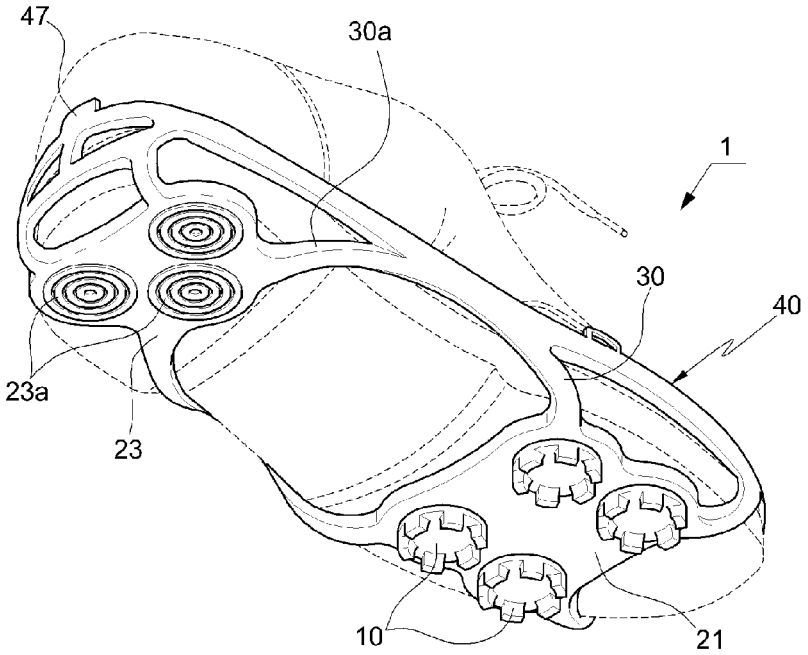
FIG. 3 is a perspective view illustrating a wearing state of the crampon in FIG. 1.

FIG. 1 is an exploded perspective view illustrating a crampon according to an embodiment of the present invention. FIG. 2 is a plan view of the crampon in FIG. 1. FIG. 3 is a perspective view illustrating a wearing state of the crampon in FIG. 1.

Referring to FIGS. 1 to 3, a crampon 1 for golf shoes according to an embodiment of the present invention includes a spike pad 20 of an elastic material provided with a plurality of spikes 10, a limb band 30 having first bands 31*a* and 31*b* extending towards a toe of shoes from two corners of the spike pad and second bands 32*a* and 32*b* extending towards a heel of the shoes from two corners, the first bands and the second bands being symmetrically formed, a circular-shaped ring band 40 connecting front ends of the limb band 30 and made of an elastic material, a trapezoidal toe locking opening A formed by the first bands 31*a* and 31*b* and a first arc portion 41 of the ring band connecting the first bands, a heel locking opening formed by the second bands 32*a* and 32*b* and a second arc portion 42 of the ring band 40 connecting the second bands, and front left and right holding portions C1 and C2 formed by a third arc portion 43 connecting the first arc portion 41 and the second arc portion 42. The second arc portion 42 formed at a rear portion of the second bands 32*a* and 32*b* extends in a circular shape, and a heel pad 23 (see FIG. 5) for supporting a heel of the shoes is coupled to the second arc portion 42 via the heel limb band 30*a*.

Preferably, the heel pad 23 is provided with a recessed portion 23*a* for preventing slipping and absorbing shock. The recessed portion 23*a* may be concentrically arranged with several circles, as shown in the drawings.

Figure 5:
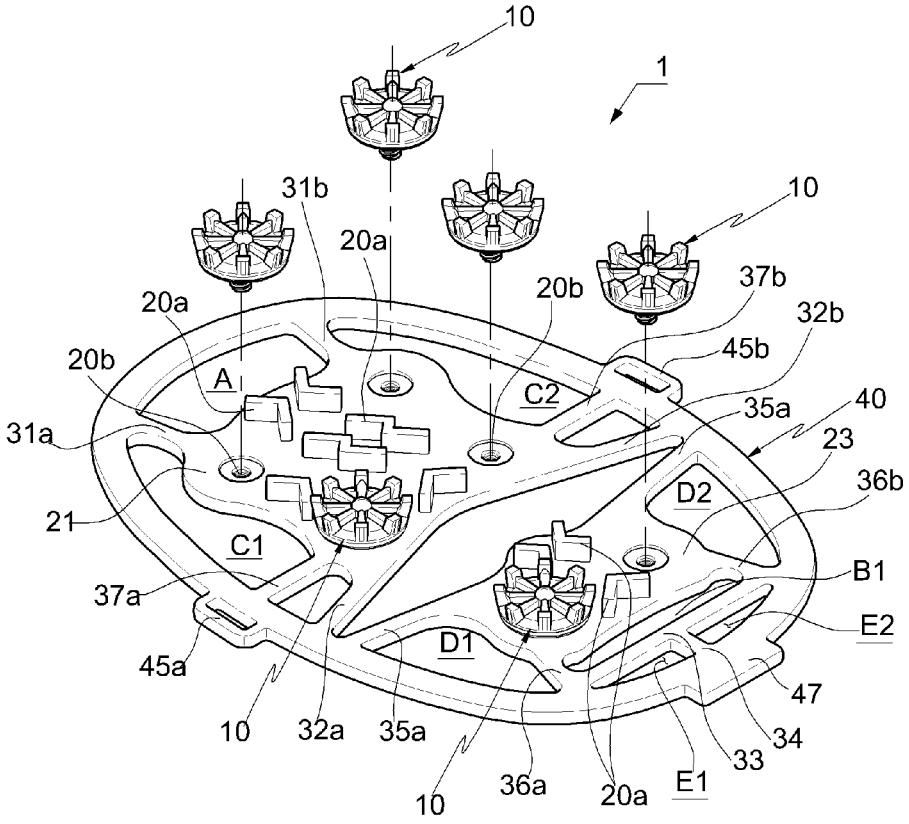
FIG. 5 is an exploded perspective view illustrating a crampon according to an embodiment of the present invention.
Figure 6:
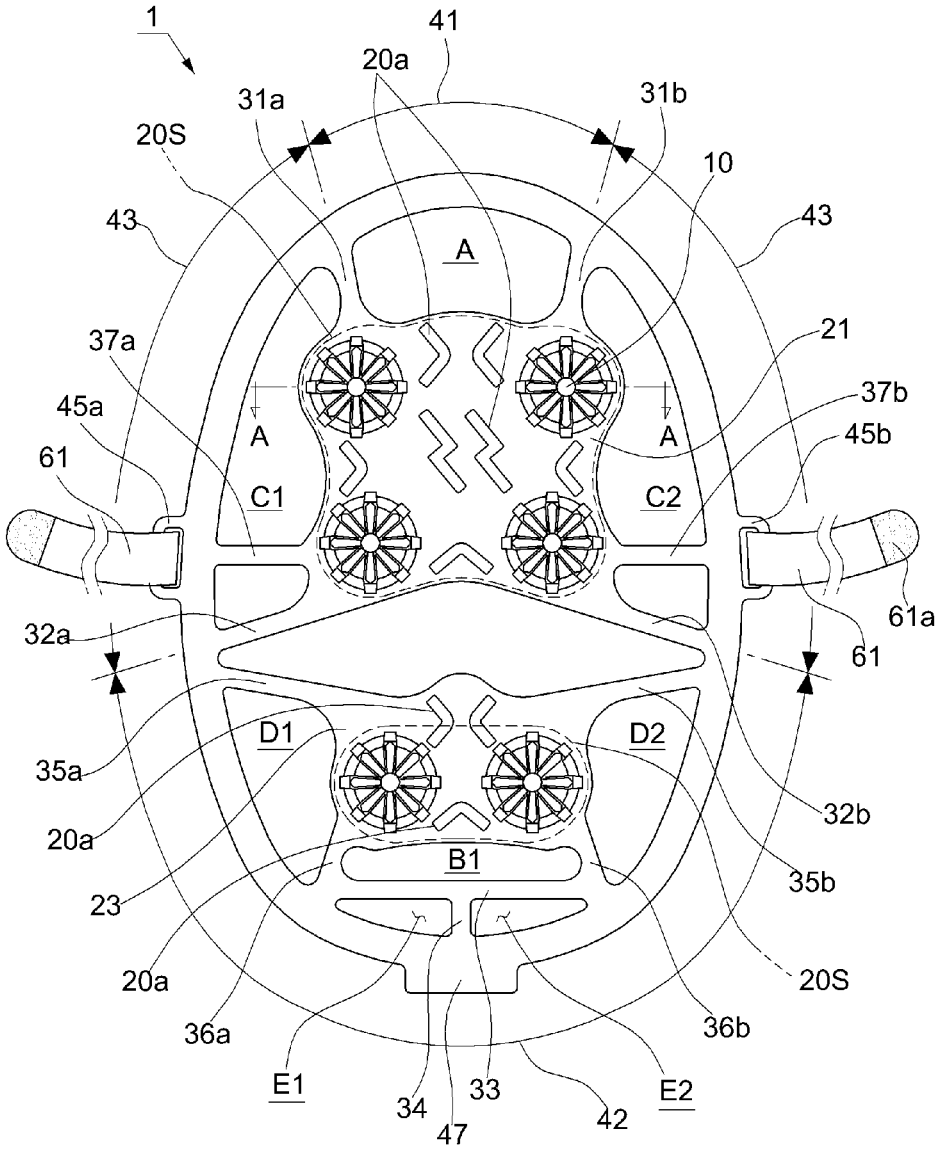
FIG. 6 is a plan view of the crampon in FIG. 5.

The heel pad 23 may be provided one or more spike 10 (see FIGS. 5 and 6).

The heel limb band 30*a* consists of fifth bands 35*a* and 35*b* coupled to the second arc portion 42 of the ring band at front left and right sides of the heel pad 23, and sixth bands 36*a* and 36*b* coupled to the second arc portion 42 at rear left and right sides of the heel pad 23.

Also, the heel pad 23 is provided with a third band 33 extending across a space of the front end of the second are portion 42, and a fourth band 34 connecting the center portion of the third band 33 with the center portion of the second arc portion 42. The left and right sixth bands 36*a* and 36*b* are coupled to the third band 33, which forms a heel locking opening B1 for locking the heel of the shoes. Rear left and right holding portions D1 and D2 are formed by cooperation with the sixth band, the fifth band and the second arc portion, and rear holding portions E1 and E2 are formed by cooperation with the third band, the fourth band and the second arc portion.

Figure 4:
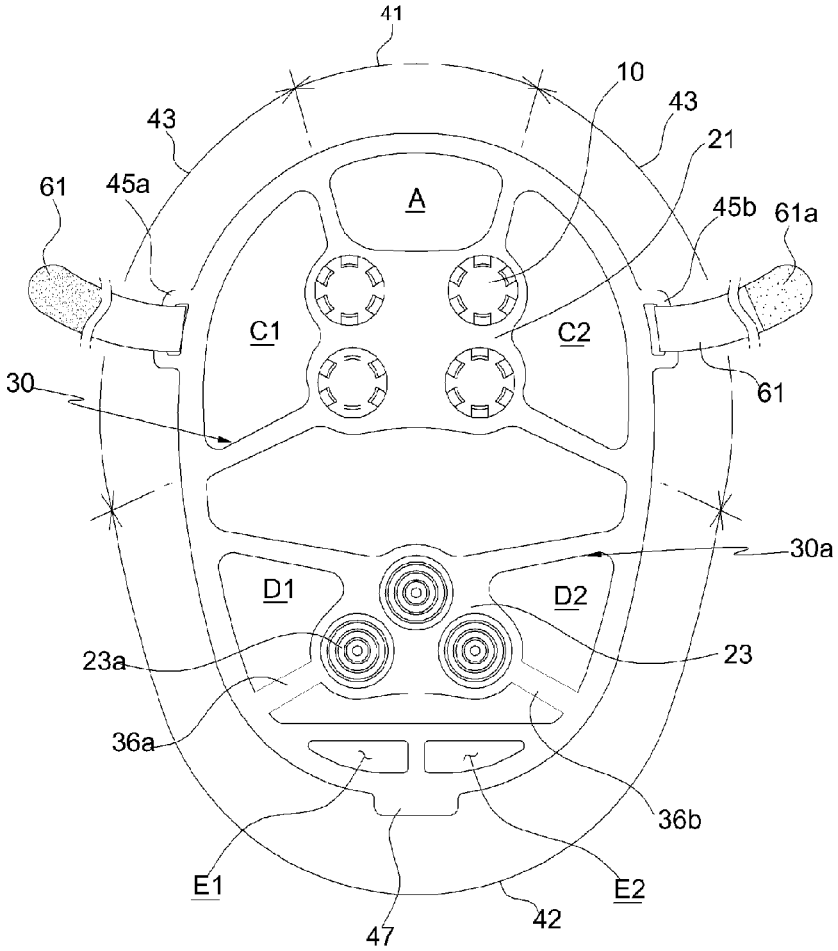
FIG. 4 is a plan view illustrating a crampon according to an embodiment of the present invention.

The fifth band is inclined forwardly, and the sixth band is formed towards the third band or coupled to the second arc portion in symmetry with the fifth band (see FIG. 4).

Also, the ring band may be provided at left and right sides thereof with a fastening band 61 and band fastening portions 45*a* and 45*b* so as to fasten an upper portion of the shoes.

The fastening band 71 may be attached with a Velcro fiber fastener 61*a*.

Preferably, a heel tap 47 protrudes from a rear end of the second arc portion 42.

The spike 10 may be integrally formed with the spike pad 20 through insert injection molding or may be coupled to the splice pad 20 via a rivet.

Preferably, the crampon of the present invention is made of rubber or silicon having good elasticity, except for the spike.

Explaining the wearing the crampon of the present invention, as shown in FIG. 3, if the heel tap 47 is pulled towards the heel of the shoes by a hand, with the toe locking opening A being locked on the toe of the shoes, the first arc portion 41 is naturally moved up on the top of a foot, and simultaneously, the front left and right holding portions C1 and C2 enclose the front left and right sides of the shoes. Also, the rear holding portions E1 and E2 enclose the heel, and the rear left and right holding portions D1 and D2 enclose the rear left and right sides of the shoes to resiliently press the sides. As a result, the crampon is firmly mounted on the shoes.

Figure 7:
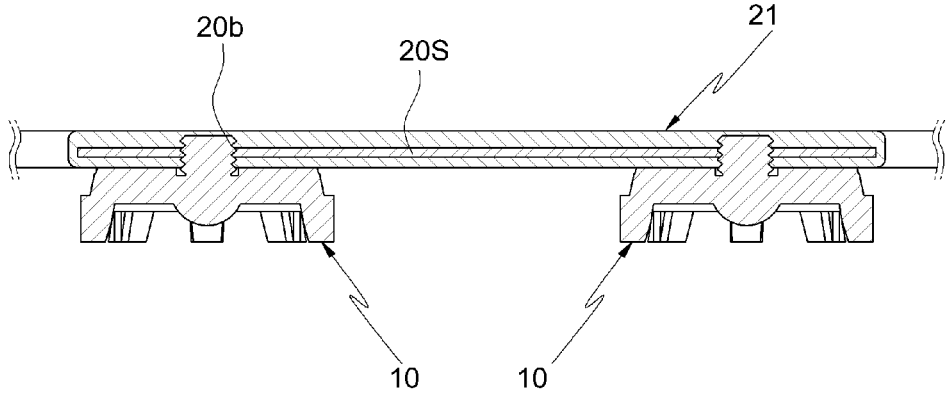
FIG. 7 is a cross-sectional view taken along line A-A in FIG. 6.

FIG. 5 is an exploded perspective view illustrating a crampon according to an embodiment of the present invention. FIG. 6 is a plan view of the crampon in FIG. 5. FIG. 7 is a cross-sectional view taken along line A-A in FIG. 6.

Referring to FIGS. 5 to 7, according to a crampon of the present invention, a spike pad 20 and a heel pad 23 have a core layer made of a steel plate 20S therein, and a ring band 40 is formed in an elliptic shape.

Preferably, the steel plate 20S is made of spring steel, in which a sheet of the steel plate is installed on the entire surface of the pad, and are provided with one or more spikes.

Reinforcing cleats 20*a* protrude from the spike pad 20 and the heel pad 23.

The spike pad 20 and the heel pad 23 are provided with threaded holes 20*b* formed in the core layer made of the steel plate 20S, and the spike 10 is provided with a threaded portion 11 which is threadedly engaged with the threaded portion 11.

Figure 8:
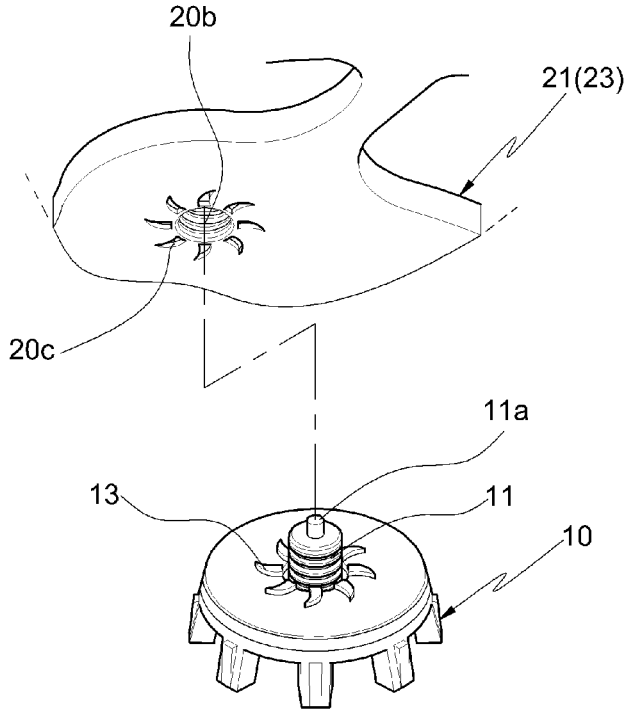
FIG. 8 is a view illustrating a spike mounting structure according an embodiment of the present invention.
Figure 9:
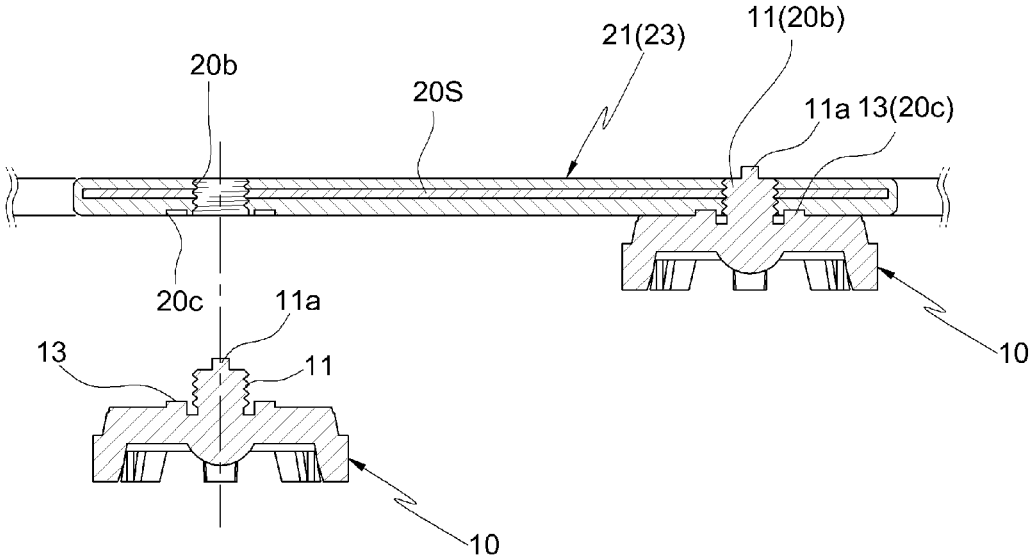
FIG. 9 is a cross-sectional view of the spike mounting structure in FIG. 8.

As an alternative embodiment, referring to FIGS. 8 and 9, a spike 10 is provided with a latch boss 13 formed on an upper surface thereof so that the spike 10 is rotated in only one direction. The spike pad 20 and the heel pad 23 are provided with a latch groove 20*c* corresponding to the latch boss 13 at a fastening position of the spike.

In this instance, the spike 10 may be provided with an anti-slip boss 11*a* protruding from an upper end of the threaded portion 11.

Figure 10:
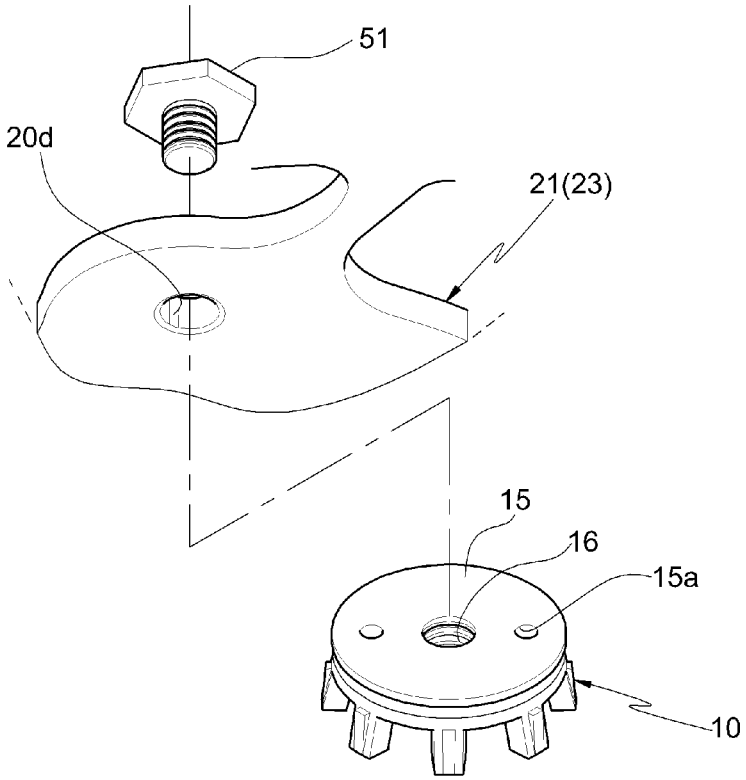
FIG. 10 is a view illustrating a spike mounting structure according an embodiment of the present invention.
Figure 11:
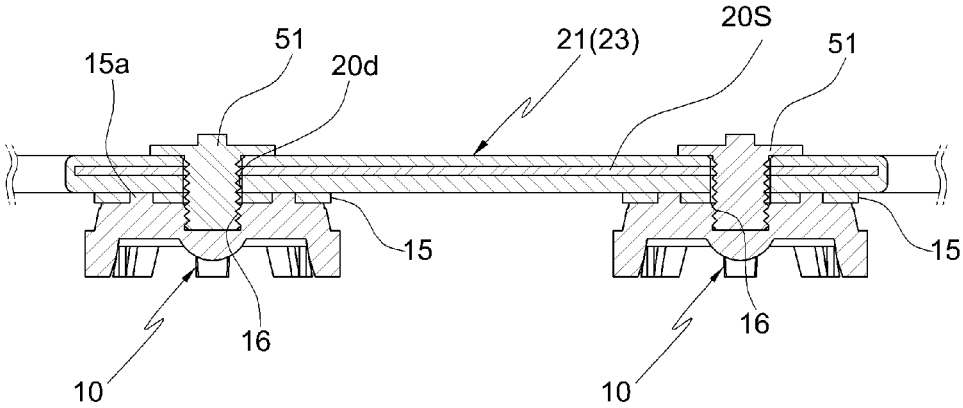
FIG. 11 is a cross-sectional view of the spike mounting structure in FIG. 10.

As an alternative embodiment, referring to FIGS. 10 and 11, a spike 10 and a heel pad 23 are provided with a through-hole 20*d* to fastening the spike 10, through which a screw 51 is inserted. The spike 10 has a washer 15 firmly attached to an upper end thereof, and a threaded hole 16 corresponding to the screw 51 is formed in the washer 15. That is, a threaded portion is formed in the washer 15 for the threaded engagement.

In this instance, the washer 15 having a threaded hole 15*a* may be integrally formed with the spike 10 through insert injection molding.

With the construction, the threaded engagement is firmly achieved if the spike is made of resin.

Figure 13:
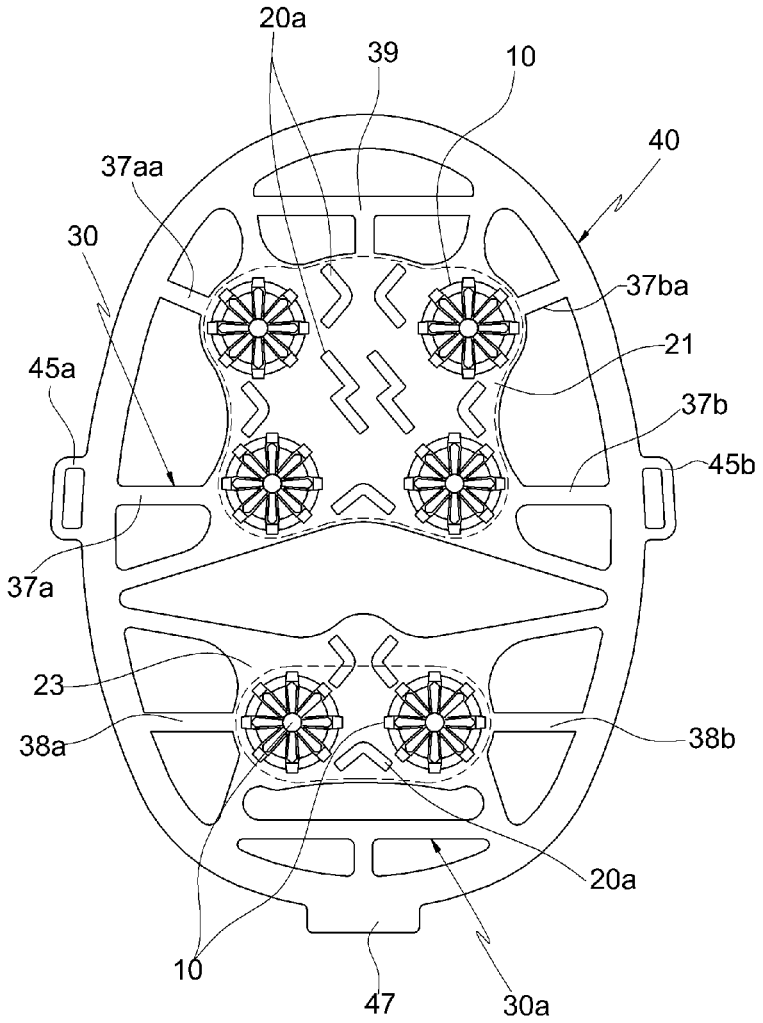
FIG. 13 is a plan view illustrating a crampon according to an embodiment of the present invention.

As an alternative embodiment, a T-shaped auxiliary band 39 is formed in a space of the toe locking opening A (see FIG. 13).

The auxiliary band 39 supports the toe of the shoes, thereby preventing the toe from colliding against a hard road surface upon walking which absorbs shock and prevents noise.

More specifically, since the T-shaped auxiliary band 39 is formed in the space of the toe locking opening A, it prevents the toe of the shoes from colliding against the road surface. Therefore, when walking on the hard road surface, it absorbs the shock applied to the shoes to reduce the fatigue, and prevents the noise at steps.

As an alternative embodiment, the front left and right holding portions C1 and C2 may be provided in the rear space thereof with left and right fastening bands 37*a* and 37*b* for preventing distortion (see FIG. 6). In addition, the front left and right holding portions C1 and C2 may be provided in the front space thereof with left and right bands 37*aa* and 37*ba* (see FIG. 13).

The seventh bends 37*a* and 37*b* prevent distortion of the shoes when the shoes are twisted at swing operation, thereby firmly and stably maintaining the wearing state of the crampon.

Also, the heel left and right holding portions D1 and D2 may be provide with left and right eighth bands 38*a* and 38*b* for connecting the heel pad 23 with the ring band 40 (see FIG. 13).

The firm wearing of the crampon is achieved by the eighth bands 38*a* and 38*b* and the bands 37*aa* and 37*ba*.

The spike 10 of the present invention is made of resin, rubber or steel.

Figure 12:
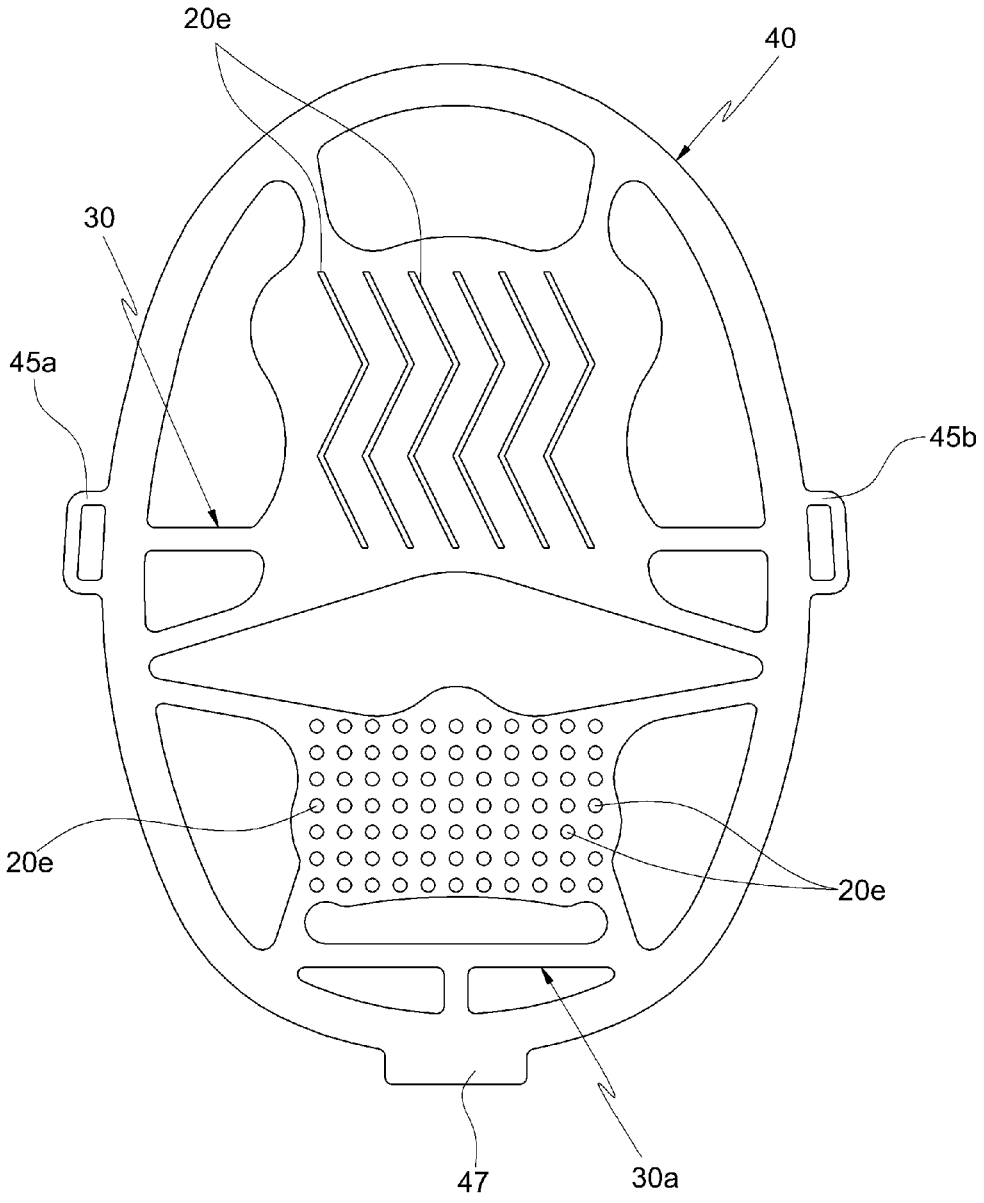
FIG. 12 is a bottom view illustrating the crampon in FIG. 5.

Preferably, plural recessed grooves 20*e* for preventing the crampon from being slid on the shoes are formed on upper surfaces of the spike pad 20 and the heel pad 23 (see FIG. 12).

Figure 14:
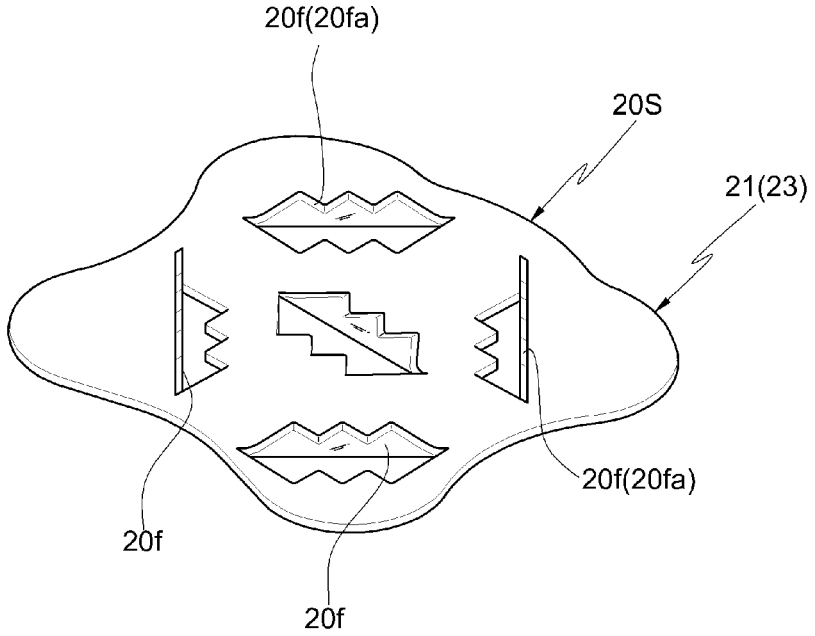
FIG. 14 is a perspective view illustrating a steel plate according to an embodiment of the present invention.
Figure 17:
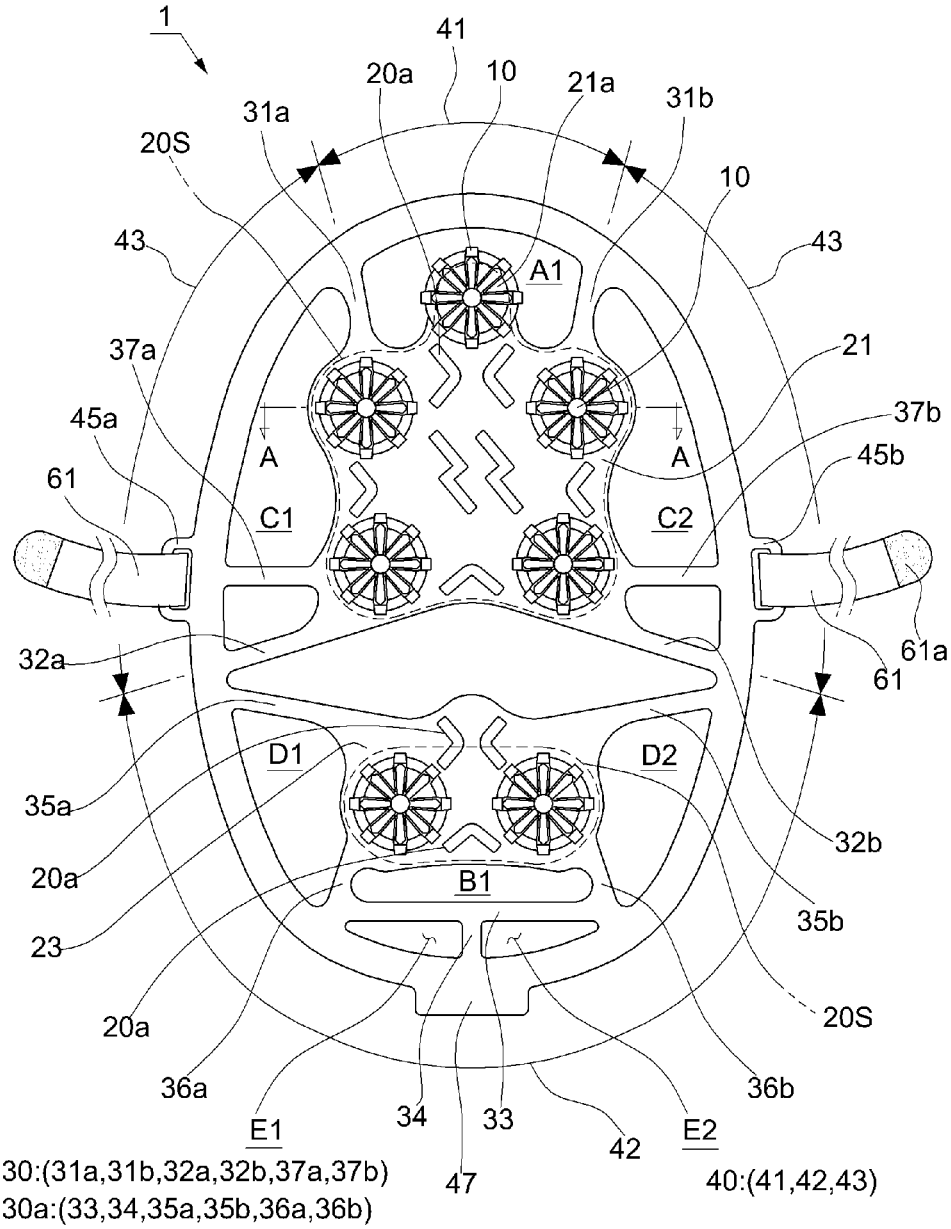
FIG. 17 is a plan view illustrating a crampon according to an embodiment of the present invention.

As an alternative embodiment, the steel plate 20S with plural cleats 20*f* is formed through insert injection molding, so that the cleats 20*f* protrude downward from the pads 20 and 23 (see FIGS. 14 and 15).

In this instance, the cleats 20*f* is formed by cutting and bending a portion of the steel plate 20S, and is machined to have a serrated portion at a front end 20*fa* thereof.

As an alternative embodiment, the pad 20 includes a toe stud 21*a* protruding towards the space of the toe locking opening A to mount the spike 10.

Since the core layer made of the steel plate 20S is formed in the pads 21 and 23, it has strength sufficient to support the spike 10.

More specifically, the steel plate 20S is installed in the pads 21 and 23 through insert injection molding, and the threaded hole 20*b* for fixing the spike is formed in the pads through the steel plate 20S. Consequently, the steel plate serves as a nut, which provides the spike with the sufficient supporting force.

Also, the latch boss 13 is formed on the upper surface of the spike 20, and the latch groove 20*c* corresponding to the latch boss 13 is formed on the pad. Consequently, the releasing rotation of the spike 10 is prevented, thereby preventing the spike from being released from the pads 21 and 23.

As shown in FIGS. 10 and 11, the through-hole 20*d* is formed in the pad, and the threaded hole 16 is formed in the spike 10. When the spike is fastened by means of the screw 51 which is inserted into the pads 21 and 23, a thickness of the pads 21 and 23 can be reduced.

The crampon of the present invention can be used for general shoes to convert the shoes into golf shoes, and can be used for climbing irons for preventing sliding on the ice by changing material and construction of the spike 10.

As shown in FIGS. 14 and 15, the climbing irons can be made by integrally forming the spike 10 on the steel plate 20S.

More specifically, if the spike 10 is formed in a circular shape, the internal space of the spike is filled with snow or ice, which reduces the function of the spike. If the spike is formed in a linear shape, as shown in FIGS. 14 and 15, the function of the spike is not deteriorated by the snow or ice.

Also, the steel plate 20S is installed in the pad as a core layer, the pad has the sufficient strength. In particular, the wear feeling is improved by the auxiliary band 39 and the seventh bands 37*a* and 37*b*, and the wearing state is stably maintained.

As described above, the crampon according to the present invention can keep a swing posture on the skiddy grass, instead of expensive golf shoes. Also, the crampon can be used as the climbing irons. Because of the small volume and light load, the crampon has a cheap and conveniently portable advantage. In addition, it is easily used and maintained since the crampon has a simple construction.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

With the above description, the crampon can be worn on general footwear for golf shoes and climbing irons, in which because of small volume and light load, the crampon has a cheap and conveniently portable advantage.

The invention claimed is:

1. A crampon (1) for golf shoes, comprising:

a spike pad (20) of an elastic material provided with a plurality of spikes (10); a limb band (30) having first bands (31*a*, 31*b*) extending towards a toe of shoes from two corners of the spike pad and second bands (32*a*, 32*b*) extending towards a heel of the shoes from two corners, the first bands and the second bands being symmetrically formed;

a circular-shaped ring band (40) connecting front ends of the limb band (30) and made of an elastic material;

a trapezoidal toe locking opening (A) formed by the first bands (31*a*, 31*b*) and a first arc portion (41) of the ring band (40) connecting the first bands (31*a*, 31*b*);

a heel locking opening formed by the second bands (32*a*, 32*b*) and a second arc portion (42) of the ring band (40) connecting the second bands (32*a*, 32*b*); and front left and right holding portions (C1, C2) formed by a third arc portion (43) connecting the first arc portion (41) and the second arc portion (42); wherein the second arc portion (42) formed at a rear portion of the second bands (32*a*, 32*b*) extends in a circular shape, and a heel pad (23) for supporting a heel of the shoes is coupled to the second arc portion (42) via a heel limb band (30*a*);

the ring band (40) forms a substantially oval or elliptical circumference;

the heel limb band (30*a*) comprises fifth bands (35*a*, 35*b*) coupled to the second arc portion (42) of the ring band at front left and right sides of the heel pad (23), and sixth bands (36*a*, 36*b*) coupled to the second arc portion (42) at rear left and right sides of the heel pad (23);

the heel pad (23) is provided with a third band (33) extending across a space of a front end of the second arc portion (42), and a fourth band (34) connecting a center portion of the third band (33) with a center portion of the second arc portion (42);

the left and right sixth bands (36*a*, 36*b*) are coupled to the third band (33), which forms a heel locking opening (B1) for locking the heel of the shoes;

rear left and right holding portions (D1, D2) are formed by cooperation with the sixth band, the fifth band and the second arc portion;

rear holding portions (E1, E2) are formed by cooperation with the third band, the fourth band and the second arc portion;

the second bands (32*a*, 32*b*) and fifth bands (35*a*, 35*b*) define a diamond-shaped opening therebetween, reinforcing cleats (20*a*) protrude from the spike pad (20) and the heel pad (23) and comprise a first set of angular-shaped cleats (20*a*) arranged between the fifth (35*a*, 35*b*) and sixth (36*a*, 36*b*) bands such that two of said reinforcing cleats (20*a*) point towards each other in a lateral direction and a third reinforcing cleat (20*a*) points to an area between said two reinforcing cleats (20*a*) in a normal direction and away from said heel locking opening (B1), and a second set arranged between the first (31*a*, 31*b*) and fifth (35*a*, 35*b*) bands such that a first two of said angularly-shaped reinforcing cleats (20*a*) point towards each other in the lateral direction, a second two of said angularly-shaped reinforcing cleats (20*a*) point towards each other in the lateral direction, a fifth angularly-shaped reinforcing cleat (20*a*) points to an area between said first two reinforcing cleats (20*a*) in the normal direction, and two zig-zag shaped cleats (20*a*) are positioned in an area between said five angularly-shaped cleats (20*a*), and four spikes (10) are positioned between the first (31*a*, 31*b*) and fifth (35*a*, 35*b*) bands and two spikes (10) are positioned between the fifth (35*a*, 35*b*) and sixth (36*a*, 36*b*) bands.

2. The crampon as claimed in claim 1, wherein the heel pad (23) is provided with a recessed portion (23*a*) protruding from the heel pad for preventing slipping and absorbing shock.

3. The crampon as claimed in claim 1, wherein the heel pad (23) is provided with one or more spikes (10).

4. The crampon as claimed in claim 1, wherein a heel tap (47) protrudes from a rear end of the second arc portion (42).

5. The crampon as claimed in claim 1, wherein the spike (10) is integrally formed with the spike pad (20) through insert injection molding or is coupled to the spike pad (20) via a rivet.

6. The crampon as claimed in claim 1, wherein the spike pad (20) and the heel pad (23) have a core layer made of a steel plate (20S) therein, and the spike pad (20) is removably mountable to a bottom of a shoe together with the crampon (1).

7. The crampon as claimed in claim 6, wherein the spike pad (20) and the heel pad (23) are provided with threaded holes (20*b*) formed in the core layer made of the steel plate (20S), and the spike (10) is provided with a threaded portion (11) which is threadedly engaged with the threaded portion (11).

8. The crampon as claimed in claim 7, wherein the spike (10) is provided with a latch boss (13) formed on an upper surface thereof so that the spike (10) is rotated in only one direction, and the spike pad (20) and the heel pad (23) are provided with a latch groove (20*c*) corresponding to the latch boss (13) at a fastening position of the spike.

9. The crampon as claimed in claim 6, wherein the steel plate (20S) with a plurality of cleats (20*f*) is formed through insert injection molding, so that the cleats (20*f*) protrude downward from the pads (20, 23).

10. The crampon as claimed in claim 9, wherein the cleats (20*f*) is formed by cutting and bending a portion of the steel plate (20S), and is machined to have a serrated portion at a front end (20*fa*) thereof.

11. The crampon as claimed in claim 6, wherein a plurality of reinforcing cleats (20*a*) protrude from the spike pad (20) and the heel pad (23).

12. The crampon as claimed in claim 1, wherein a plurality of reinforcing cleats (20*a*) protrude from the spike pad (20) and the heel pad (23).

13. The crampon as claimed in claim 1, wherein a plurality of recessed grooves (20*e*) for preventing the crampon from being slid on the shoes are formed on upper surfaces of the spike pad (20) and the heel pad (23).

14. The crampon as claimed in claim 1, wherein the pad (20) includes a toe stud (21*a*) protruding towards the space of the toe locking opening (A) to mount the spike (10).

* * * * *